US005699921A

United States Patent [19]

Rodriguez

[11] Patent Number: 5,699,921

[45] Date of Patent: Dec. 23, 1997

[54] SYSTEM FOR USE IN DELIVERING AIR INTO THE INTERIOR OF A BABY-BOTTLE

[76] Inventor: Victor Jose Rodriguez, Notre Dame H-21, Caquas, Puerto Rico, 725

[21] Appl. No.: 630,931

[22] Filed: Apr. 5, 1996

[51] Int. Cl.[6] ..... A61J 9/00; A61J 9/04

[52] U.S. Cl. ..... 215/11.5; 215/378; 215/902

[58] Field of Search ..... 215/11.1, 11.3, 215/11.4–11.6, 902, 378; 137/513.5, 515.7

[56] References Cited

U.S. PATENT DOCUMENTS

| | | | |
|---|---|---|---|
| 362,554 | 5/1887 | Suydam | 215/11.5 |
| 458,906 | 9/1891 | Jordan | 215/11.5 X |
| 3,134,495 | 5/1964 | Carbonel | 215/11.5 |
| 3,200,980 | 8/1965 | Jamell | 215/11.5 |
| 3,768,683 | 10/1973 | Van Den Bosch | 215/11.6 X |
| 4,339,046 | 7/1982 | Coen | 215/11.3 X |
| 4,723,668 | 2/1988 | Cheng | 215/11.5 |
| 4,821,896 | 4/1989 | Cheng | 215/11.3 |
| 4,979,629 | 12/1990 | Askerneese | 215/11.1 |
| 5,078,287 | 1/1992 | Holmes, III | 215/11.1 |
| 5,339,971 | 8/1994 | Röhrig | 215/11.5 |

FOREIGN PATENT DOCUMENTS

| | | | |
|---|---|---|---|
| 630766 | 11/1961 | Canada | 215/11.4 |
| 1058610 | 3/1954 | France | 215/11.5 |
| 2139903 | 11/1984 | United Kingdom | 215/11.1 |

*Primary Examiner*—Sue A. Weaver

[57] ABSTRACT

The present invention relates to a system for use in delivering air into the interior of a baby bottle while the baby is feeding. Thus, the device of the present invention enables a smoother delivery of feeding fluids to the baby while avoiding unwanted vacuums within the interior of the baby bottle. In its broadest context, the present invention includes a baby bottle having a bottom end with an aperture formed therein. A threaded bottom cap is adapted to be threadably secured over the bottom portion of the bottle. This cap portion has an aperture which is adapted to be aligned with the aperture of the bottom of the baby bottle. A one-way valve is adapted to be removably positioned in between the aperture of the bottom of the baby bottle and the aperture of the bottom cap. Thus, the one-way valve ensures that air can be delivered to the bottom interior region of the baby bottle without any air escaping from the bottom interior region of the baby bottle.

1 Claim, 3 Drawing Sheets

FIG 1
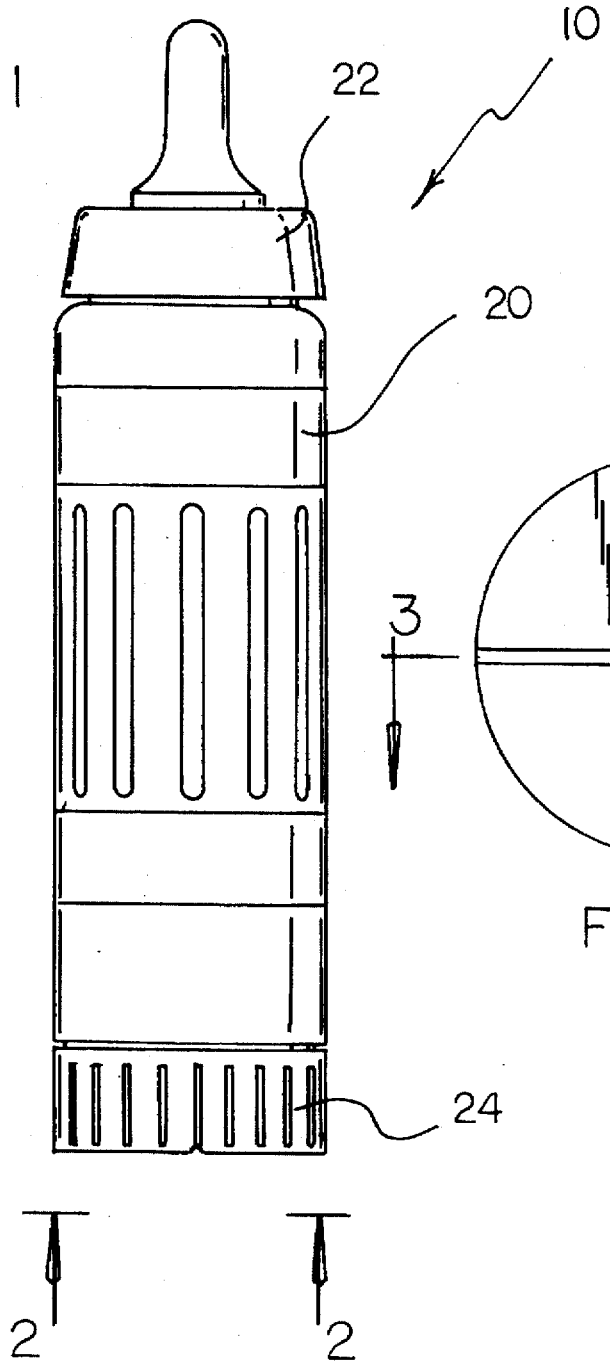
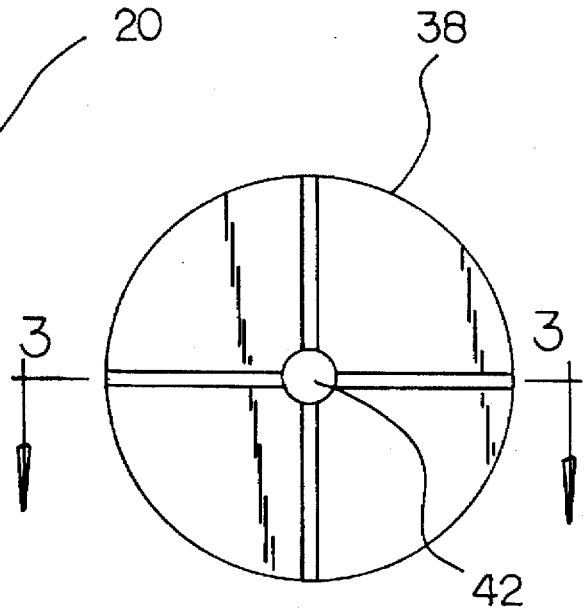
FIG 2

SYSTEM FOR USE IN DELIVERING AIR INTO THE INTERIOR OF A BABY-BOTTLE

BACKGROUND OF THE INVENTION

1. Field of the Invention

The present invention relates to a system for use in delivering air into the interior of a baby bottle and, more particularly, pertains to a baby bottle with a removable one-way valve.

2. Description of the Prior Art

The use of feeding bottles for infants are known in the prior art. More specifically, feeding bottles for infants heretofore devised and utilized for the purpose of a feeding an infant are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,723,668 to Cheng discloses a feeding bottle structure with a valve. U.S. Pat. No. 5,339,971 to Rohig discloses a feeding bottle. U.S. Pat. No. 4,979,629 to Askerneese discloses an air expeller and supply receptacle for a nursing bottle. U.S. Pat. No. 5,078,287 to Holmes, III, discloses a variable size nursing bottle. U.S. Pat. No. 4,685,577 to Chen discloses a nursing bottle. U.S. Pat. No. 4,401,224 to Alonso discloses a feeding bottle for infants. U.S. Pat. No. 4,061,254 to Nilson discloses a dispensing valve. U.S. Pat. No. 4,339,046 discloses a nursing bottle.

In this respect, the system for use in delivering air into the interior of a baby-bottle according to the present invention substantially departs from the conventional concepts and designs of the prior art, and in so doing provides an apparatus primarily developed for the purpose of baby bottle with a removable one-way valve.

Therefore, it can be appreciated that there exists a continuing need for new and improved system for use in delivering air into the interior of a baby-bottle which can be used for baby bottle with a removable one-way valve. In this regard, the present invention substantially fulfills this need.

SUMMARY OF THE INVENTION

In view of the foregoing disadvantages inherent in the known types of feeding bottles for infants now present in the prior art, the present invention provides an improved system for use in delivering air into the interior of a baby-bottle. As such, the general purpose of the present invention, which will be described subsequently in greater detail, is to provide a new and improved system for use in delivering air into the interior of a baby-bottle apparatus and method which has all the advantages of the prior art and none of the disadvantages.

To attain this, the present invention essentially comprises a system for use in delivering air into the interior of a baby bottle while the baby is feeding, comprising, in combination, a plastic cylindrical container with a diameter and an interior. The container further has a forward dispensing end and a rearward bottom end. The forward dispensing end is externally threaded. The rearward bottom end has a cylindrical minor portion and a length and a diameter and is externally threaded. The diameter of the cylindrical minor portion is less than the diameter of the cylindrical container. A centrally disposed aperture is formed through the bottom end of the container. A cylindrical flange surrounds the aperture. The cylindrical flange has a length and a diameter both smaller than the length and diameter of the cylindrical minor portion. A cylindrical top cap portion is provided and has an interior region and a nipple centrally positioned within the cylindrical top cap portion. The interior region is threaded with the threads of the interior region adapted to engage with the external threads of the forward dispensing end of the cylindrical container. A plastic cylindrical bottom cap has an interior region with an aperture formed through the cylindrical bottom cap. A cylindrical flange is formed around the aperture of the bottom cap. The interior region of the bottom cap is threaded with the threads of the bottom cap adapted to engage the external threads of the cylindrical minor portion. A plastic one-way valve has a forward air expelling end and a rearward air accepting end. The one-way valve is adapted to be coupled to the cylindrical flange of the aperture of the bottom end of the container such that the forward air expelling end is adjacent the interior cylindrical container and the rearward air accepting end is adjacent the rearward bottom end of the cylindrical container. The cylindrical bottom cap is adapted to be threadably secured over the cylindrical minor portion such that the cylindrical flange of the bottom cap comes into contact with the cylindrical flange of the rearward bottom end of the cylindrical container with the one-way valve secured therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for use in delivering air into the interior of a baby-bottle which has all the advantages of the prior art feeding bottles for infants and none of the disadvantages.

It is another object of the present invention to provide a new and improved system for use in delivering air into the interior of a baby-bottle which may be easily and efficiently manufactured and marketed.

It is a further object of the present invention to provide a new and improved system for use in delivering air into the interior of a baby-bottle which is of a durable and reliable construction.

An even further object of the present invention is to provide a new and improved system for use in delivering air into the interior of a baby-bottle which is susceptible of a low cost of manufacture with regard to both materials and labor, and which accordingly is then susceptible of low prices of sale to the consuming public, thereby making such feeding bottles for infants economically available to the buying public.

Still yet another object of the present invention is to provide a new and improved system for use in delivering air into the interior of a baby-bottle which provides in the apparatuses and methods of the prior art some of the advantages thereof, while simultaneously overcoming some of the disadvantages normally associated therewith.

Still another object of the present invention is to baby bottle with a removable one-way valve.

Lastly, it is an object of the present invention to provide a system for use in delivering air into the interior of a baby bottle while the baby is feeding. Thus, the device of the present invention enables a smoother delivery of feeding fluids to the baby while avoiding unwanted vacuums within the interior of the baby bottle. In its broadest context, the present invention includes a baby bottle having a bottom end with an aperture formed therein. A threaded bottom cap is adapted to be threadably secured over the bottom portion of the bottle. This cap portion has an aperture which is adapted to be aligned with the aperture of the bottom of the baby bottle. A one-way valve is adapted to be removably positioned in between the aperture of the bottom of the baby bottle and the aperture of the bottom cap. Thus, the one-way valve ensures that air can be delivered to the bottom interior region of the baby bottle without any air escaping from the bottom interior region of the baby bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of the preferred embodiment of the system for use in delivering air into the interior of a baby-bottle constructed in accordance with the principles of the present invention.

FIG. 2 is a view taken along line 2—2 of FIG. 1.

Similar reference characters refer to similar parts throughout the several views of the drawings.

DESCRIPTION OF THE PREFERRED EMBODIMENT

Figure 3:
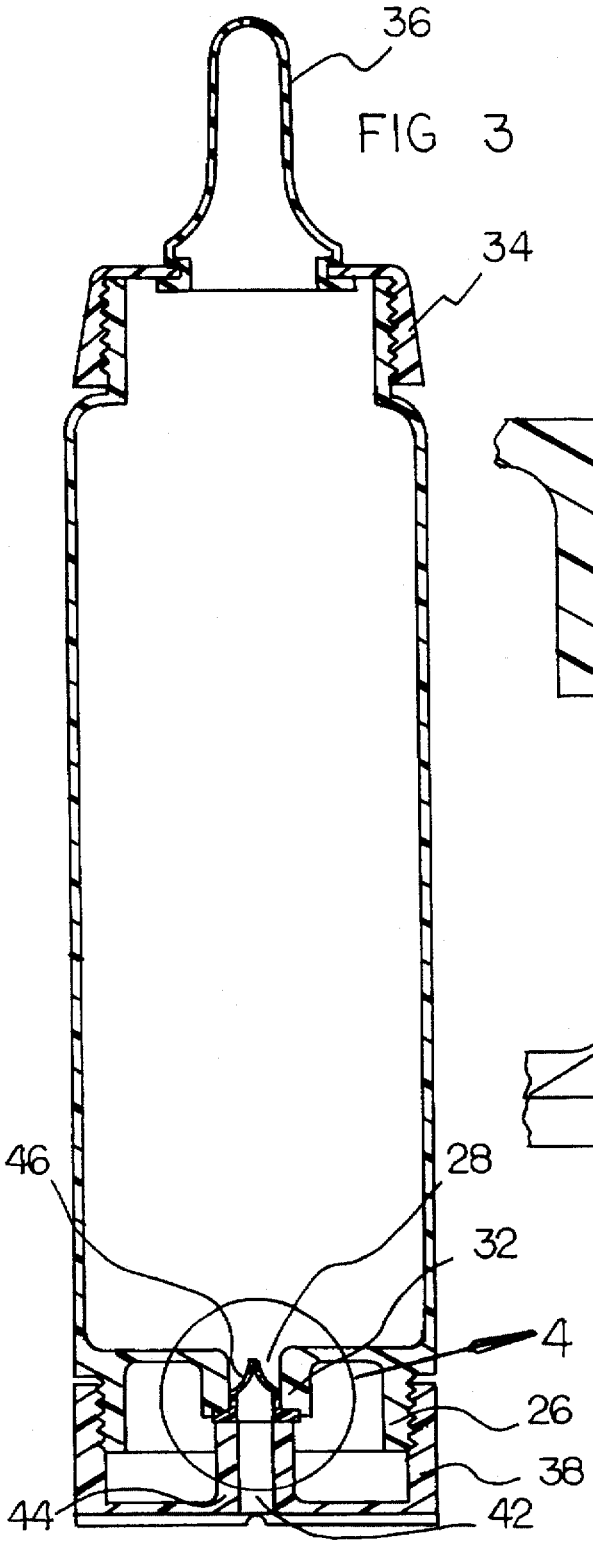
FIG. 3 is a view taken along line 3—3 of FIG. 2.
Figure 4:
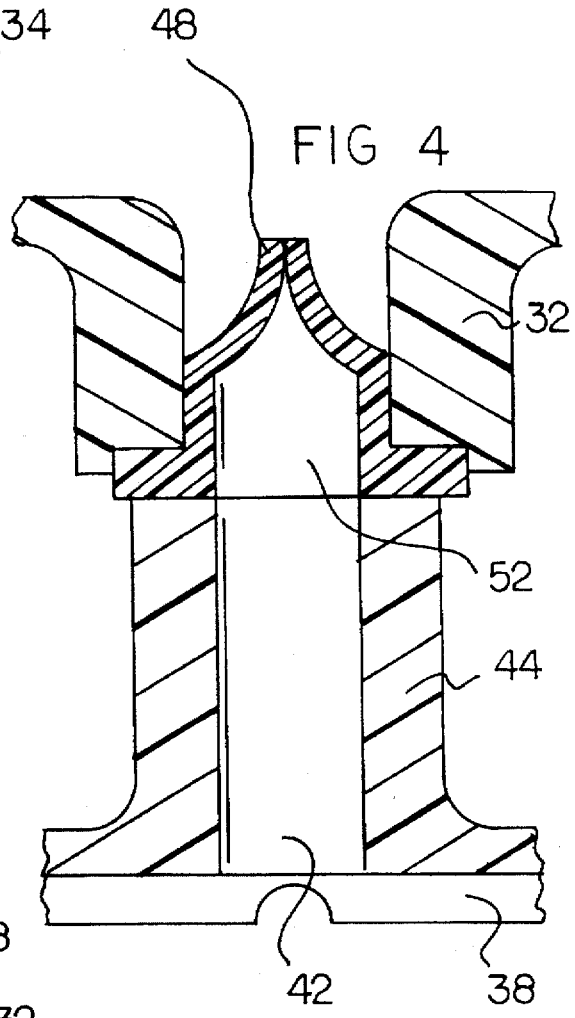
FIG. 4 is a detailed view taken from FIG. 3.

With reference now to the drawings, and in particular to FIG. 1 thereof, a new and improved system for use in delivering air into the interior of a baby-bottle embodying the principles and concepts of the present invention and generally designated by the reference numeral 10 will be described.

The present invention relates to a system for use in delivering air into the interior of a baby bottle while the baby is feeding. Thus, the device of the present invention enables a smoother delivery of feeding fluids to the baby while avoiding unwanted vacuums within the interior of the baby bottle. In its broadest context, the present invention includes a baby bottle having a bottom end with an aperture formed therein. A threaded bottom cap is adapted to be threadably secured over the bottom portion of the bottle. This cap portion has an aperture which is adapted to be aligned with the aperture of the bottom of the baby bottle. A one-way valve is adapted to be removably positioned in between the aperture of the bottom of the baby bottle and the aperture of the bottom cap. Thus, the one-way valve ensures that air can be delivered to the bottom interior region of the baby bottle without any air escaping from the bottom interior region of the baby bottle. The various components of the present invention, and the manner in which they interrelate will be described in greater detail hereinafter.

Figure 5:
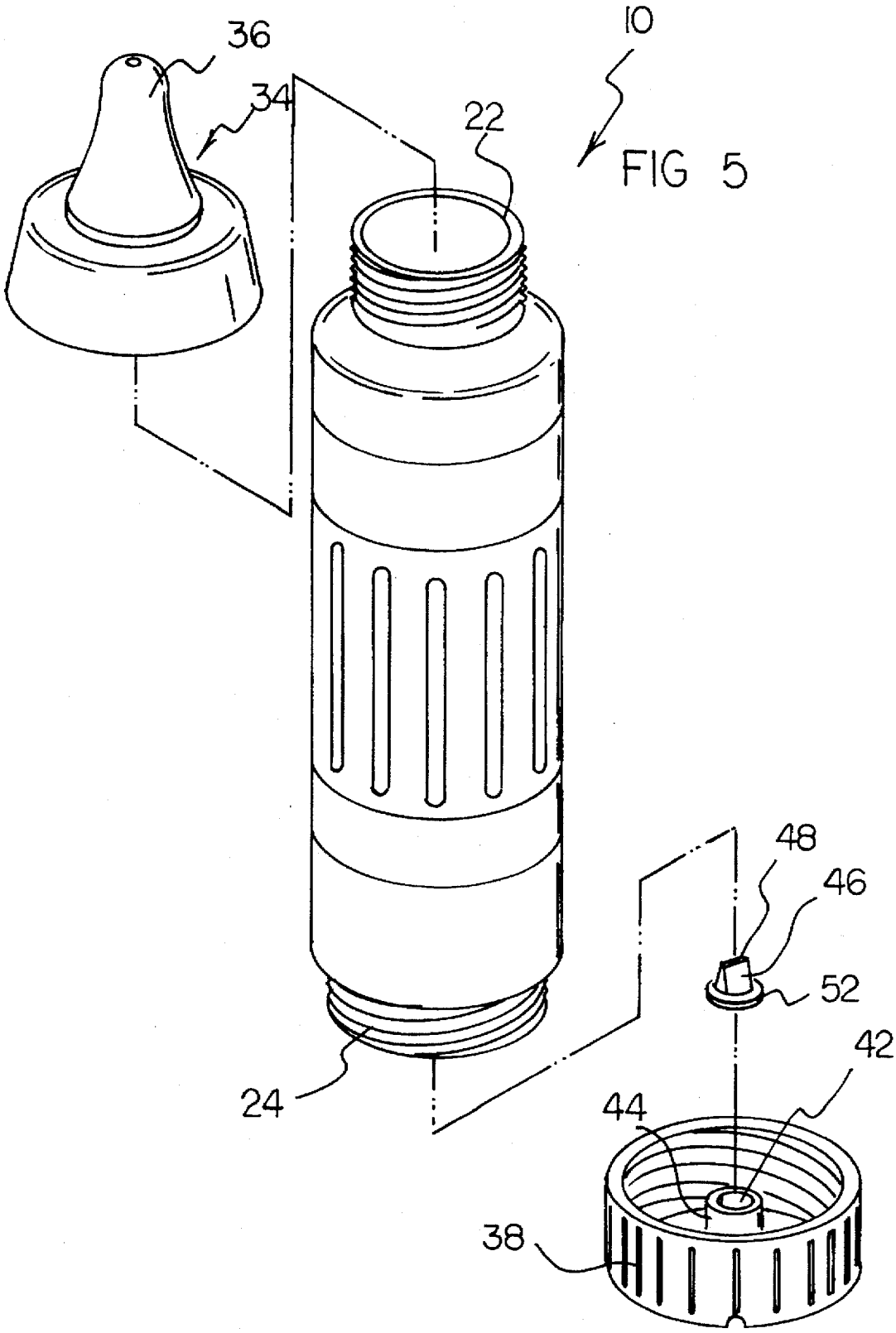
FIG. 5 is an exploded view of the device in accordance with the present invention.

The cylindrical container 20 of the device 10, in the preferred embodiment, is constructed of a light-weight plastic material. Furthermore, the cylindrical container 20 is defined by a diameter, an interior, a forward dispensing end 22 and a rearward bottom end 24. The forward dispensing end 22 is externally threaded upon its surface. The forward dispensing end 22 can most clearly be seen in FIG. 5. Furthermore, the rearward bottom end 24 has a cylindrical minor portion 26. The cylindrical minor portion 26 is defined by a length and a diameter, with the diameter of the cylindrical minor portion 26 being less than the diameter of the cylindrical container 20. This cylindrical minor portion 26 can most clearly be seen in FIG. 5. Furthermore, a centrally disposed aperture 28 is formed in the bottom end of the container 20. Furthermore, a cylindrical flange 32 surrounds this aperture 28. The cylindrical flange 32 is defined by a length and a diameter with the length and diameter both being smaller than the length and diameter of the cylindrical minor portion 26. Thus, the cylindrical minor portion 26 is formed integrally with the remainder of the cylindrical container 20, however, the cylindrical minor portion is stepped inwardly with respect to the outer surface of the cylindrical container. Furthermore, the cylindrical flange 32 is also integrally formed with the cylindrical container 20. However, it is stepped in relative to the outer surface of the cylindrical container 20 and the outer surface of the cylindrical minor portion 26. The relationship between the cylindrical container 20, the cylindrical minor portion 26 and the cylindrical flange 32 can thus be seen in FIG. 3.

The device 10 of the present invention further includes a cylindrical top cap 34. This cylindrical top cap is defined by an interior region and a top surface. A nipple 36 is securely positioned within the top surface of the cylindrical top cap 34. This nipple 36 is employed by the infant when feeding. The interior region of the cylindrical top cap 34 includes a thread formed therein with the threads of the interior region adapted to engage the external threads formed on the forward dispensing end 22 of the cylindrical container 20. Thus, the cylindrical top cap 34 is adapted to be threadably secured over the forward dispensing end 22 of the cylindrical container 20. In the preferred embodiment, the cylindrical top cap 34 is constructed from a light-weight plastic material.

A bottom cylindrical cap 38, which in the preferred embodiment is constructed of a light-weight plastic material, is defined by an interior region and a bottom surface. An aperture 42 is centrally formed through the bottom surface of the bottom cylindrical cap 38. Furthermore, a cylindrical flange is formed around this aperture. Furthermore, the interior region of the bottom cap 38 is threaded. The threads of the interior region of the bottom cylindrical cap 38 are adapted to engage the external threads of the cylindrical minor portion 26 of the rearward bottom end 24 of the cylindrical container 20. Thus, the bottom cylindrical cap 38 is adapted to be threadably secured over the cylindrical minor portion 26 to thus secure the bottom cylindrical cap to the rearward bottom end 24 of the cylindrical container 20. Furthermore, the aperture formed within the bottom portion of the cylindrical container 20, the cylindrical flange formed within the rearward bottom end 24, the cylindrical flange 44 formed within the bottom cylindrical cap 38 and the aperture 42 of the cylindrical bottom cap are all brought into alignment with each other when the bottom cylindrical cap 38 is secured over the cylindrical flange 32.

A one-way valve 46, which in the preferred embodiment is constructed of a light-weight plastic material, is adapted to be positioned intermediate the bottom cylindrical cap 38 and the rearward bottom end 24 of the cylindrical container 20. The one-way valve 46 is defined by forward an air expelling end 48 and a rearward air accepting end 52. The one-way valve 46 is adapted to be coupled to the cylindrical flange of the aperture of the bottom end 24 of the container 20 such that the forward air expelling end 48 is adjacent the interior of the cylindrical container 20 and the rearward air accepting end 52 is adjacent the rearward bottom end 24 of the cylindrical container 20. The cylindrical bottom cap 38, when threadably secured over the cylindrical minor portion 26 serves to secure the one-way valve 46 in place. More specifically, with the one-way valve 46 positioned over the cylindrical flange 32 of the rearward bottom end 24 of the container, the bottom cylindrical cap 38 can be threadably secured over the cylindrical minor portion 26 such that the cylindrical flange 44 of the bottom cylindrical cap 38 comes into contact with the rearward air accepting end 52 of the one-way valve 46. In this manner, with the bottom cylindrical cap 38 secured over the cylindrical minor portion 26, the one-way valve 46 is securely positioned intermediate the cylindrical flange 32 and the cylindrical flange 44.

Thus, when a baby is feeding from the device of the present invention, any vacuum which is normally created by sucking is automatically released by the unique valve system. This makes feeding easier for the baby and greatly reduces the quantity of ingested air.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved system for use in delivering air into the interior of a baby bottle while the baby is feeding, comprising, in combination:

a plastic cylindrical container with a diameter and an interior having a forward dispensing end and a rearward bottom end, the forward dispensing end being externally threaded, the rearward bottom end having a cylindrical minor portion having a length and a diameter and being externally threaded, the diameter of the cylindrical minor portion being less than the diameter of the cylindrical container, a centrally disposed aperture formed through the bottom end of the container, a cylindrical flange surrounding the aperture and extending downwardly from the bottom end, the cylindrical flange having a length and a diameter both smaller than the length and diameter of the cylindrical minor portion;

a cylindrical top cap portion having an interior region and a nipple centrally positioned within the cylindrical top cap portion, the interior region being threaded with the threads of the interior region adapted to engage with the external threads of the forward dispensing end of the cylindrical container;

a plastic cylindrical bottom cap having an interior region with an aperture formed through the cylindrical bottom cap, a cylindrical flange formed around the aperture of the bottom cap and extending upwardly therefrom, the interior region of the bottom cap being threaded with the threads of the bottom cap adapted to engage the external threads of the cylindrical minor portion; and a plastic one-way valve having a forward air expelling end and a rearward air accepting end, the one-way valve adapted to be coupled to the cylindrical flange of the aperture of the bottom end of the container such that the forward air expelling end is adjacent the interior cylindrical container and the rearward air accepting end is adjacent the rearward bottom end of the cylindrical container, the cylindrical bottom cap adapted to be threadably secured over the cylindrical minor portion such that the cylindrical flange of the bottom cap interconnects with the cylindrical flange of the rearward bottom end of the cylindrical container with the one-way valve secured therebetween.

* * * * *